US007131146B2

(12) United States Patent
Chatman

(10) Patent No.: US 7,131,146 B2
(45) Date of Patent: Nov. 7, 2006

(54) STAY-PUT SLIP

(76) Inventor: Linda Chatman, 155 N. Harbor Dr., #2912, Chicago, IL (US) 60601

( * ) Notice: Subject to any disclaimer, the term of this patent is extended or adjusted under 35 U.S.C. 154(b) by 44 days.

(21) Appl. No.: 10/895,227

(22) Filed: Jul. 20, 2004

(65) Prior Publication Data

US 2005/0246817 A1 Nov. 10, 2005

Related U.S. Application Data

(63) Continuation-in-part of application No. 10/224,165, filed on Aug. 20, 2002, now abandoned.

(51) Int. Cl.
*A41B 9/10* (2006.01)
*A41B 9/00* (2006.01)

(52) U.S. Cl. ..... 2/78.1; 2/211; 2/214

(58) Field of Classification Search ..... 2/46–48, 2/73, 50, 78.1–78.3, 78.4, 211, 214, 271, 2/216, 311–313, 109, 110, 112, 217, 309, 2/77, 113, 69, 74, 75, 105, 223; 450/100, 450/106, 110, 112, 113, 152; D2/700, 703, D2/705, 721–723

See application file for complete search history.

(56) References Cited

U.S. PATENT DOCUMENTS

| | | | | | |
|---|---|---|---|---|---|
| 1,376,783 | A | * | 5/1921 | Schoen | 2/46 |
| 1,488,773 | A | * | 4/1924 | Anchorstar | 450/101 |
| 1,599,638 | A | * | 9/1926 | Buchanan | 450/101 |
| 2,742,648 | A | * | 4/1956 | Blatt | 450/106 |
| 3,399,679 | A | * | 9/1968 | Barg | 450/95 |
| 5,566,392 | A | * | 10/1996 | Dzelzkalns | 2/73 |

* cited by examiner

*Primary Examiner*—Gloria M. Hale
(74) *Attorney, Agent, or Firm*—Michael Best & Friedrich LLP

(57) ABSTRACT

A garment including a skirt has at least one ribbon or ring that attaches to the inside surface of the skirt and is appropriately sized and situated to encircle the leg of a person who is wearing the skirt in order to make the garment stay put. The garment may be, for example, a slip, a dress or a coat. The ribbon or ring is attached to the skirt along less than the entire length of the ribbon or ring. The ribbon or ring may be removably attached to the skirt, and may be adjustable for circumferential length and for elevation with respect to the skirt.

21 Claims, 3 Drawing Sheets

STAY-PUT SLIP

CROSS-REFERENCE TO RELATED APPLICATIONS

The present application is a continuation-in-part of patent application Ser. No. 10/224,165, filed on Aug. 20, 2002 now abandoned.

FIELD OF THE INVENTION

The field of invention generally relates to undergarments, and particularly to those undergarments worn under skirts and dresses.

BACKGROUND OF THE INVENTION

The modern slip evolved in tandem with dresses and skirts and has generally been subject to the same fashion trends. Early slip-like garments include relatively bulky petticoats that were popular in the nineteenth century and cotton linings of the twentieth century. Today, "slip" means a relatively thin, generally opaque or translucent lining, which includes a skirt portion and is intended to be worn as an undergarment. "Skirt" means that part of a dress, coat, robe or other article of clothing intended to hang below the waist and encompass at least a portion of both of the wearer's legs, and excludes any covering which extends around and along one of the wearer's legs individually such as, for example, a trouser leg.

While slips have met with almost universal acceptance, they are subject to unwanted displacement along the body of the wearer. This unwanted displacement is both unsightly and uncomfortable, and is sometimes referred to as "riding up".

One example of a slip is described in U.S. Pat. No. 1,350,848, issued to Starkweather. The slip of the '848 patent reportedly facilitates passage of air between and through the slip and the outer skirt. However, the slip of the '848 patent appears to be susceptible to riding up.

Clothing designers have from time to time redesigned separate garments to produce a single, unitary undergarment. For example, U.S. Pat. No. 1,121,005, issued to Farnsworth, describes an undergarment combining four separate articles of clothing into a single, unitary undergarment. The '005 patent reports that a slip-, panty-, bust supporter- and skirt-supporter combination is worn under a dress in lieu of separate undergarments.

U.S. Pat. No. 1,419,940, issued to Mills, describes a combination of a panty and a petticoat to form a single, unitary undergarment. These unitary undergarments, to the extent that they include skirts, are not immune to riding up on the wearer's body.

Undergarments have also been incorporated into outer garments to form unitary, multifunctional clothing. For example, U.S. Pat. No. 1,037,331, issued to Savage, describes a skirt to which bloomers are directly attached. The unitary garments are improvements in that they require fewer garments to clothe the wearer. However, neither the unitary undergarments nor the unitary outer garments, by themselves, solve the problem of a slip riding up.

Ordinarily, a slip is a loosely fitting, nonconforming garment. However, some slips have been combined with girdles or corsets, or stand alone in a manner that restricts or controls the shape of the body. For example, in U.S. Pat. No. 3,399,679, issued to Barg, a slip is combined with a legged girdle. Front and back panels are reportedly attached to the girdle, so that an onlooker cannot see through the garment when it is worn in public.

U.S. Pat. No. 5,566,392, issued to Dzelzkalns, describes a relatively confining, no-slip undergarment. The garment of the '392 patent combines shorts constructed of elastic material with a front panel that serves as a built-in slip. The elastic material is said to keep pantyhose in place and to retain the slip in its proper position on the wearer's body. However, a need still exists for a loosely fitting, free-flowing slip that maintains its position and is resistant to riding up.

A relatively recent and currently popular development in slip design is known as a "slimmer slip." The slimmer slip includes panels constructed of a carefully-controlled elastic material, which is engineered to eliminate wrinkles in certain portions of the skimmer slip and to gently smooth the wearer's figure without significantly constricting the wearer's body. However, slimmer skirts are very susceptible to riding up. A need exists for an improved slimmer skirt that does not ride up.

Wearers would welcome a freely flowing slip that is immune to unwanted skirt displacement. Desirably, the freely flowing slip moves naturally with the wearer and flounces in a graceful and attractive manner. Preferably, the freely flowing slip is less restrictive and more comfortable, as compared to previously known undergarments. More preferably, the freely flowing slip can be made in a wide array of styles and designs, and constructed from a variety of fabrics.

SUMMARY OF THE INVENTION

In accordance with the present invention, a garment including a skirt has at least one ring or ribbon that attaches to the inside surface of the skirt. The ring or ribbon is appropriately sized and situated to encircle or entwine the leg of a person who is wearing the skirt, in order to make the garment stay put or in the desired position. The garment may also include, for example, a waistband and a hem. Depending on the desires and preferences of the user, different patterns, designs, and styles are available for the garment, as well as lace and other decorative materials. The garment can be made of a wide array of fabrics, so the user may wear a thinner, cooler fabric during the warmer months and a thicker, warmer fabric during the winter months. The rings are typically made of elastic or other suitable resilient material, and are attached, either permanently or temporarily, to the inside of the slip just above the hem. In a preferred embodiment, the skirt is attached to each ring along approximately one-half of the ring's circumferential length. The remaining circumferential length of the ring is free or not directly attached to the slip.

The rings may be composed of a rigid material or a supple material. Means for adjusting the rings to fit the legs of a person wearing the garment can be provided for rings that are relatively inelastic.

Regardless of the ring material, the rings are attached where they cannot be seen when the user is wearing the slip. Permanent rings are attached by sewing them to the inside of the slip. Temporary rings are attached to the slip by hook and loop fasteners, snaps, buttons, clips, hooks, tying or other similar means. By removably attaching the rings, the user has the option to use the rings interchangeably with other slips or not to use them at all.

In another preferred embodiment, removable rings are employed that are also vertically adjustable. For example, horizontal strips of hook and loop fasteners or rows of hooks and eyelets may be attached to the inside of the slip, each strip or row being vertically spaced apart from the other strip or rows. The wearer may vertically adjust the placement of the rings to fit the wearer's individual height. This vertical adjustment may also be used to control the degree of movement which the skirt displays in response to the wearer's movements.

The unique design of the garment permits a wearer to keep the garment, such as a slip, in place without sacrificing style or comfort.

BRIEF DESCRIPTION OF DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF PREFERRED EMBODIMENTS OF THE INVENTION

Figure 1:
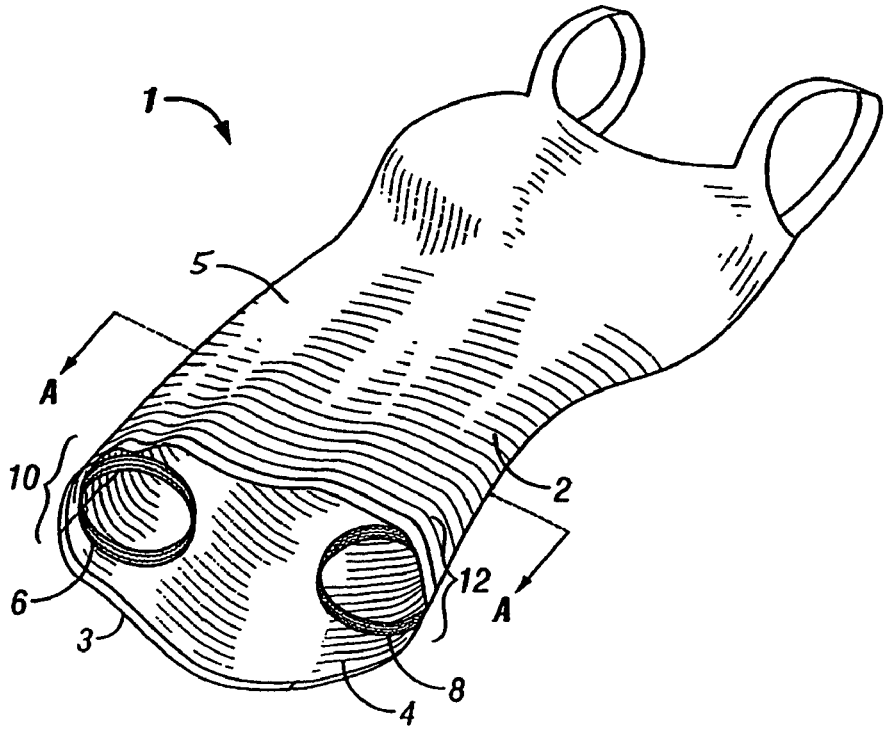
FIG. 1 is a perspective view of a slip of the present invention, as seen from the front of the slip, with rings shown in broken lines to indicate a hidden view.

In a preferred embodiment, the invention is a slip 1, as depicted in FIG. 1. Slip 1 is intended to be worn by a person, and comprises skirt 2 and one or more rings 6, 8. The slip 1 is worn as an undergarment underneath additional garments. In some aspects and in some constructions, the skirt 2 is formed at least partially from an elastic material, such as spandex, or any similar material made from an elastic fiber that may be stretched repeatedly and still recover to substantially its original length and shape. An example of an elastic or spandex material includes LYCRA®. The entire skirt 2 may be formed from the elastic material, or alternatively, only portions of the skirt 2 may include the elastic material.

Figure 5:
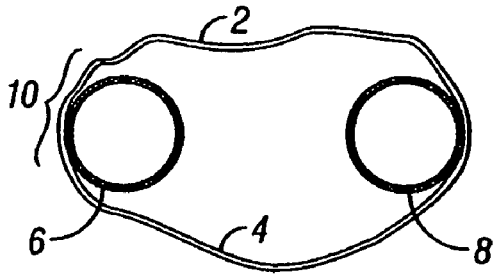
FIG. 5 is a cross-sectional view showing plane A—A of the slip depicted in FIG. 4.

The slip 1 may include a top portion, a lower edge 3, an inner surface 4 generally facing the wearer of the slip 1, and a waist 5 positioned between the top portion and lower edge 3. Each of rings 6, 8 is attached to the inner surface 4 of skirt 2 for encircling one of the legs of a person. FIGS. 1 and 5 illustrate that each of the rings 6, 8 is attached to inner surface 4 of skirt 2 along a distance 10, 12 of about one-half or less of the circumferential length of ring 6 or 8.

Rings 6, 8 are preferably doughnut-shaped hoops or bands of generally circular outline. They may be continuous hoops or have ends that are fastened together. Preferably, two rings, 6, 8 are attached to inner surface 4, and each ring 6 or 8 is located diametrically opposite one another and adjacent one of the legs of the wearer, respectively. Each of rings 6, 8 is attached to inner surface 4 of skirt 2. Each of rings 6, 8 is of appropriate size for receiving one of the legs of a person.

Rings 6, 8 may be composed of relatively rigid materials such as plastic, for example. Preferably, rings 6, 8 are composed of relatively supple materials, such as elastic, cloth, cord or rope. Rings 6, 8 may be solid strips of material or hollow structures. The cross-section of each of rings 6, 8 may be, for example, elliptical or rectangular. Preferably, rings 6, 8 are relatively thin. The length of each of the rings 6, 8 is at least large enough to fit about the circumference of the wearer's leg.

Each of rings 6, 8 is appropriately situated on the inner surface 4 for receiving one of the wearer's legs, and yet remains concealed from view by others when slip 1 is worn. Each of rings 6, 8 is attached to the inner surface 4 near the lower edge 3 of the skirt 2. The lower edge 3 generally defines a main opening of the skirt 2 and a person's legs extend through the main opening while wearing the slip 1. The skirt 2 may include a hem located adjacent the lower edge 3. The rings 6, 8 are attached near the lower edge 3, and are preferably located within the first few inches of the lower edge 3 on the inner surface 4. In a preferred embodiment, the rings 6, 8 are located within two inches of the lower edge 3.

If rings 6, 8 are composed of an elastic material, the rings are sized to conform to the size and shape of the wearer's leg. If ring 6 or 8 is composed of an inelastic material, means for adjusting the length of the ring 6, 8 are preferably provided.

Rings 6, 8 can be permanently attached by, for example, sewing them to inner surface 4. Alternatively, one or more of rings 6, 8 may be removably attached to inner surface 4. Suitable means for removable attachment include hook and loop fasteners, hooks and eyelets, snaps, buttons, buckles, and other fasteners and tying. When rings 6, 8 are removably attached, the wearer has the option to use rings 6, 8 interchangeably with other slips or not to use them at all.

Figure 2:
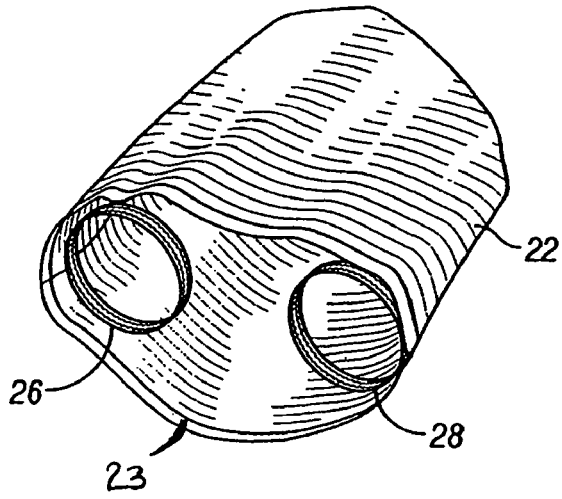
FIG. 2 is a partial perspective view of a slip the present invention, with rings composed of relatively elastic material.

FIG. 2 is an enlarged partial view of skirt 22, showing rings 26, 28 composed of relatively elastic material. Rings 26, 28 are typically made of elastic or other suitable resilient material and attached, either permanently or temporarily, to the inner surface 24 just above hem or lower edge 23. Preferably, skirt 22 is attached to each ring 26 or 28 along a distance, such as distance 10, 12 depicted in FIG. 1, of approximately one-half of the ring's circumferential length. In that case, approximately one-half or more of the length of ring 26 or 28 is free or not directly attached to slip 22.

Figure 3:
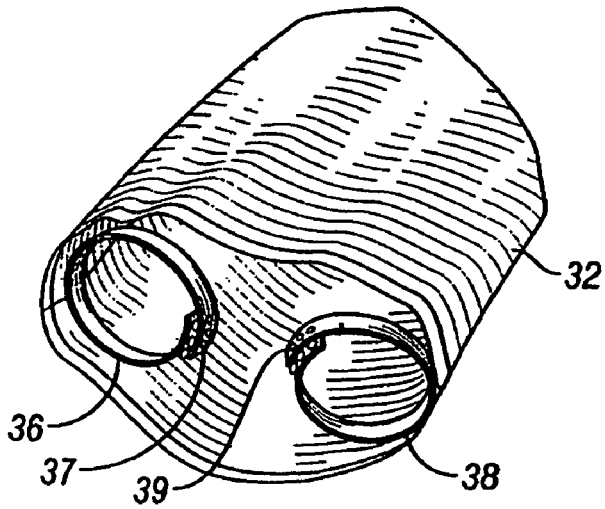
FIG. 3 is a partial perspective view of a slip the present invention, with rings composed of relatively inelastic material and adjustable for length.

FIG. 3 depicts a partial perspective view of skirt 32, showing rings 36, 38 composed of thin strips of relatively inelastic material. Rings 36, 38 are fitted with a plurality of snaps 37, 39 for adjusting the length of rings 36, 38. The wearer may adjust this length for maximum comfort and, also, to control the freedom of skirt 32 with respect to the wearers movements.

Figure 4:
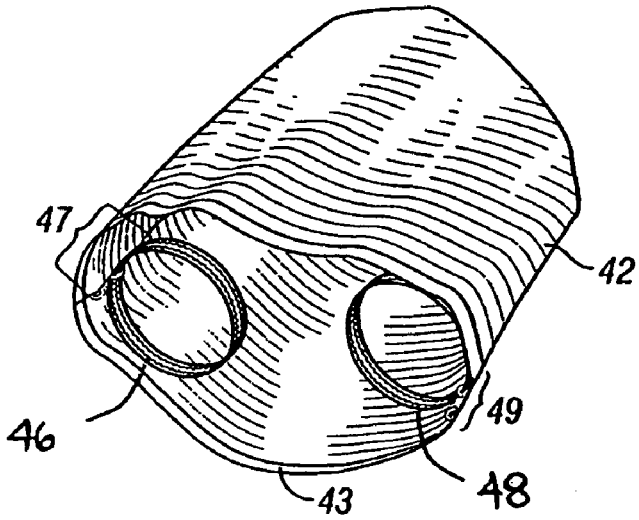
FIG. 4 is a partial perspective view of a slip the present invention, with rings repositionably attachable for vertical adjustment.

Turning now to FIG. 4, rings 46, 48 are shown attached to skirt 42, which includes three rows of hooks and eyelets 47, 49, which are suitable for removably attaching rings 46, 48 at various elevations with respect to skirt 42 and hem 43. Alternatively, horizontal strips of hook and loop fasteners or rows of hooks and eyelets may be attached to the inner surface 44 of slip 42, each strip or row being vertically spaced apart from the other strip or rows. These arrangements permit the wearer to adjust the vertical placement of rings 46, 48 to precisely match a wearer's individual height or personal preference for comfort. Adjusting the vertical placement of rings 46, 48 may be also be done to enhance desirable aesthetic effects, which become apparent as the skirt sways or whirls in response to the wearer's movements.

Figure 6:
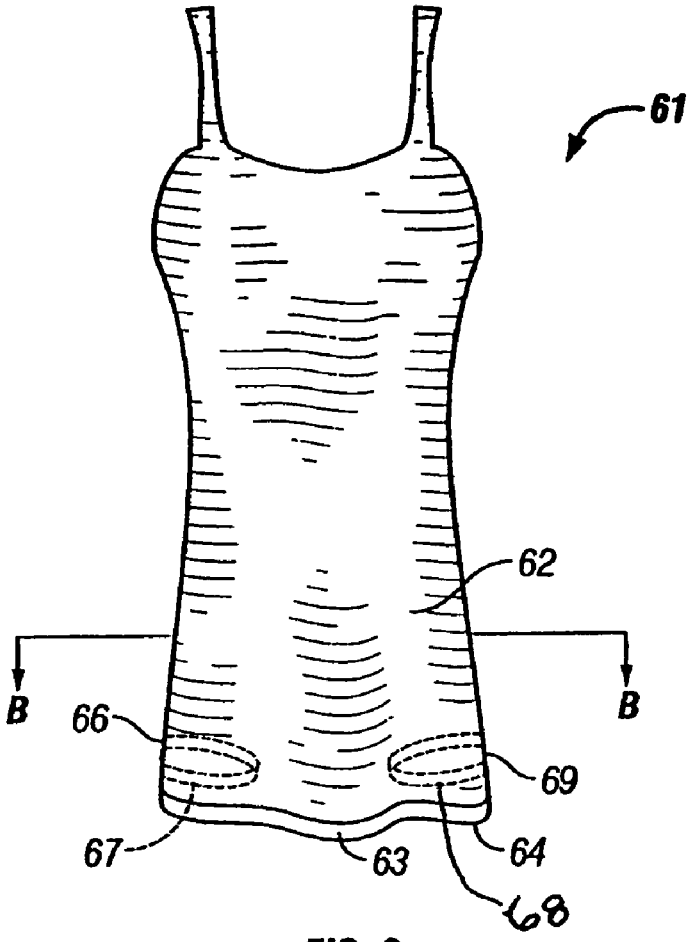
FIG. 6 is a partial perspective view of a slip the present invention; with loops formed cooperatively by the inside surface of the skirt and ribbons attached to the inside surface.
Figure 7:
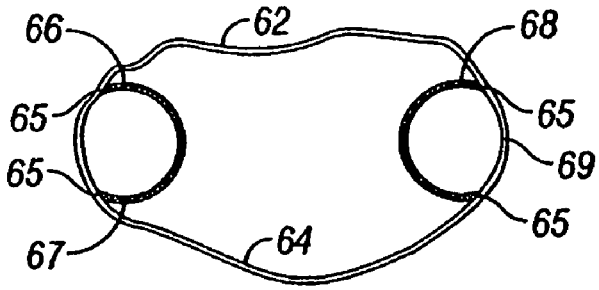
FIG. 7 is a cross-sectional view showing plane B—B of the slip depicted in FIG. 6.

In another preferred embodiment, the invention is a slip, such as slip 61 in FIG. 6. Slip 61 includes skirt 62 and one or more ribbons 66, 68. Each of ribbons 66, 68 is attached to inner surface 64 of skirt 62. Each of ribbons 66, 68 is arranged to form a portion of one of loops 67, 69 of appropriate size for receiving one of the legs of a person. Each of ribbons 66 or 68 may have one or more ends 65, which are best seen in FIG. 7. Ends 65 are permanently or removably attached to inner surface 64 by, for example, sewing or by any suitable fastener. When ribbons 66, 68 are removably attached, the wearer has the option to use ribbons 66, 68 interchangeably with other slips or not to use them at all. The ribbons, in combination with inner surface 64 of skirt 62 encircle the legs and complete the loops 67, 69.

Alternatively, an intermediate portion of one of the ribbons may be attached to inner surface 64, and ends 65 may be joined to each other to form the loop (67 or 69). In this case, ends 65 may be joined by, for example, sewing or tying the ends together or employing a fastener mounted on the ribbon (67 or 69) adjacent end 65.

The length of each of the ribbons 66, 68 is preferably at least about one-half of, but less than the entire circumference of the wearer's leg. For comfort and proper appearance, the width and the thickness of each of ribbons 66, 68 is preferably significantly less than its length. Each of ribbons 66, 68 are appropriately situated on inner surface 64 for receiving one of the legs and yet remaining concealed from view when the person is wearing the garment. Preferably, each of ribbons 66, 68 is attached to inner surface 64 at an elevation higher than that of skirt hem 63, which is located adjacent a lower edge of skirt 62.

Ribbons 66, 68 may be composed of an elastic material that conforms to the size and shape of the person's leg. If ribbons 66 or 68 are composed of an inelastic material, means for adjusting the length of the ribbon 6, 8 are preferably provided. For example, one the of the ends 65 may be detachably joined to the same ribbon or to skirt 62 in order to adjust the length of the ribbon 66 or 68.

The embodiments described above and illustrated in the figures are presented by way of example only and not intended as a limitation upon the concepts and principles of the present invention. As such, it will be appreciated by one having ordinary skill in the art that various changes in the elements and their configuration and arrangement are possible without departing from the spirit and scope of the present invention.

The invention claimed is:

1. A slip, which comprises:

a skirt having an inner surface and a lower edge that is substantially continuous around both legs of a person wearing the slip, the skirt being at least partially formed of an elastic material;

a first ring attached to the inner surface of the skirt near the lower edge and sized for encircling a first leg of the person while wearing the slip;

a second ring attached to the inner surface of the skirt near the lower edge, and the second ring sized for encircling a second leg of the person while wearing the slip, said skirt encircling both said rings.

2. The slip of claim 1 wherein each ring is composed essentially of an elastic material.

3. The slip of claim 1 in which each ring is composed essentially of an in elastic material, and the slip includes means for adjusting the length of each ring to conform to the size and shape of the corresponding leg of the person wearing the slip.

4. The slip of claim 1 wherein each ring is attached to the inner surface within a first few inches of the lower edge of the skirt.

5. The slip of claim 1 wherein each ring is spaced apart from the other.

6. The slip of claim 1 wherein each ring is removably attached to the skirt.

7. The slip of claim 1 wherein each ring has a free end that is removably attachable to at least one of the ring and the skirt to form a loop for receiving one of the legs of the person wearing the skirt.

8. The slip of claim 1 wherein the skirt is at least partially formed of an elastic material including spandex.

9. A slip which comprises:

a skirt having a lower edge and an inner surface, the skirt being at least partially formed of an elastic material;

a ring attached to the inner surface of the skirt near the lower edge and sized for encircling one of the legs of a person while wearing the slip; and fasteners vertically spaced from one another along the inner surface for attachment to the ring and for adjusting the elevation of the ring with respect to the lower edge of the skirt.

10. The slip of claim 9 wherein the ring is composed essentially of an elastic material.

11. The slip of claim 9 in which the ring is composed essentially of an inelastic material, and the slip includes means for adjusting the length of the ring to conform to the size and shape of one of the legs of the person wearing the slip.

12. The slip of claim 9 wherein each ring has a free end that is removably attachable to either the secured end of the ring or skirt to form a loop for receiving one of the legs.

13. An undergarment for a person, which comprises:

a skirt having a waist, a lower edge that is substantially continuous around both legs of the person wearing the slip, and an inner surface, the skirt being at least partially formed of an elastic material;

a ribbon encircled by said skirt, said ribbon having ends attached in different locations to the inner surface of the skirt near the lower edge, and wherein said ribbon in combination with the inner surface of the skirt between said different locations forms a loop of appropriate size for encircling only one of the legs of a person while wearing the undergarment.

14. The undergarment of claim 13 further comprising a second ribbon, each of the ribbons attached to the inner surface of the skirt and located diametrically opposite one another and sized for encircling, respectively, one of the legs of the person while wearing the undergarment.

15. The undergarment of claim 13 wherein the ribbon is composed essentially of an elastic material.

16. The undergarment of claim 13 wherein the ribbon is composed essentially of an inelastic material, and the undergarment includes means for adjusting the length of the ribbon to conform to the size and shape of one of the legs of the person wearing the undergarment.

17. The undergarment of claim 13 wherein the ribbon is attached to the inner surface within a first few inches of the lower edge of the skirt.

18. The undergarment of claim 13 wherein the ribbon is attached to the inner surface within two inches of the lower edge of the skirt.

19. The undergarment of claim 13 wherein the ribbon is removably attached to the skirt.

20. The undergarment of claim 13 wherein the ribbon has a free end that is removably attachable to at least one of the ribbon and the skirt to form a loop for receiving one of the legs of the person wearing the undergarment.

21. The undergarment of claim 13 wherein the skirt is at least partially formed of an elastic material including spandex.

* * * * *